US006598448B1

(12) United States Patent
Barten et al.

(10) Patent No.: US 6,598,448 B1
(45) Date of Patent: Jul. 29, 2003

(54) ROLLER COOLING AND LUBRICATING DEVICE FOR COLD ROLLING MILLS SUCH AS THIN STRIP AND FOIL ROLLING MILLS

(75) Inventors: Axel Barten, Siegen (DE); Martin Falk, Hillscheid (DE); Heinz Löcker, Kirchhundem (DE); Kurt Scheffe, Hilchenbach (DE)

(73) Assignee: Achenbach Buschhütten GmbH, Kreuztal (DE)

( * ) Notice: Subject to any disclaimer, the term of this patent is extended or adjusted under 35 U.S.C. 154(b) by 0 days.

(21) Appl. No.: 09/827,705

(22) Filed: Apr. 6, 2001

(30) Foreign Application Priority Data

Apr. 8, 2000 (DE) ..... 100 17 579

(51) Int. Cl.[7] ..... B21B 27/06
(52) U.S. Cl. ..... 72/201; 72/236; 72/342.3
(58) Field of Search ..... 72/200, 201, 236, 72/342.3; 239/550, 562

(56) References Cited

U.S. PATENT DOCUMENTS 4,671,091 A * 6/1987 Atack et al. ..... 72/201
4,706,480 A * 11/1987 Suatos ..... 72/201
4,709,568 A * 12/1987 Ticehurst et al. ..... 72/236
5,212,975 A * 5/1993 Ginzburg ..... 72/201
5,460,023 A * 10/1995 Ginzburg ..... 72/236
5,524,465 A * 6/1996 Kajiwara et al. ..... 72/201

FOREIGN PATENT DOCUMENTS

DE 3419261 12/1994
DE 9418359 2/1995

* cited by examiner

*Primary Examiner*—Ed Tolan
(74) *Attorney, Agent, or Firm*—Friedrich Kueffner

(57) ABSTRACT

A cooling and lubricating device for rollers of a cold rolling mill with one or more roll stands for controlling strip tensile stress of the strip across the width by changing the effective roll barrel diameter and/or the roller lubrication with a controlled supply of rolling oil or emulsions. The supply is pressure-, quantity-, and/or temperature-controlled. Several nozzle beams are provided and assigned to individual rollers, respectively. The nozzle beams are connected to side shields of the roll housing. Spray nozzles are mounted in the nozzle beams and distributed across the entire roller width. The nozzle beams are moveable independently relative to the rollers transverse to the strip running direction and in planes parallel to the strip plane. Rotary and linear drives are connected to the nozzle beams for rotating the nozzle beams about the longitudinal axis and for moving them in the longitudinal direction.

6 Claims, 3 Drawing Sheets

ROLLER COOLING AND LUBRICATING DEVICE FOR COLD ROLLING MILLS SUCH AS THIN STRIP AND FOIL ROLLING MILLS

BACKGROUND OF THE INVENTION

1. Field of the Invention

The invention relates to a roller cooling and/or lubricating device for cold rolling mills for strip, in particular, thin strip rolling mills and foil rolling mills, comprising nozzle beams correlated with the individual rollers and mounted on side shields of the roll housings of one or more roll stands, the nozzle beams having spray nozzles mounted therein across the width of the rollers and being adjustable relative to the correlated rollers independent from one another transverse to the running direction of the rolled strip in planes that are parallel to the strip plane, for the purpose of controlling the strip tensile stress across the strip width by a change of the effective roll barrel diameter and/or by affecting the roller lubrication with a pressure-controlled and/or quantity-controlled and/or temperature-controlled supply of rolling oil or emulsions.

2. Description of the Related Art

The flatness control of the rolled strip in a cold rolling mill for strip, which is furnished with a roller cooling and/or lubricating device of the aforementioned kind known from German patent 34 19 261 C3, is based on a change of the spray pattern of the rolling oil sprayed onto the surface of the working rollers or the sprayed-on emulsions. The change of the spray pattern is effected by an adjustment of the nozzle beam, correlated with each one of the working rollers of the cold rolling mill, relative to the working roller independent of the respective other nozzle beams transverse to the strip running direction in a plane which is parallel to the strip plane and a pressure-controlled and/or quantity-controlled and/or temperature-controlled supply of rolling oil or emulsions.

Thin strip and foil strip, which are rolled on a four-high or six-high roll stand with the known flatness control, are characterized by a high quality with respect to dimensional precision and shape precision as well as flatness.

A disadvantage of roller cooling and/or lubricating devices of the aforementioned kind for cold rolling mills of strip is the insufficient accessibility of the nozzle beams with the spray nozzles and their corresponding control valves so that repair and maintenance work on the nozzle beams is cumbersome and time-consuming.

The configuration of a roller cooling and/or lubricating device for cold rolling mills for strip, described in the German patent document DE 94 18 359.7 U1, comprising lifting beams, arranged at the inlet side of the strip on the two roll housings of a roll stand and movable in the vertical direction, and comprising also carriages, movable on the lifting beams in the horizontal direction and having support arms for the nozzle beams for movement thereof from a maintenance position, remote from the rollers, into a working position at the rollers and from the working position into the maintenance position, is technically complex.

SUMMARY OF THE INVENTION

It is an object of the present invention to optimize the control of the strip flatness in cold rolling mills for strip by means of the aforementioned roller cooling and/or lubricating device in order to compensate undesirable strip tensile stress deviations within zones in the rolled strip and to improve the accessibility of the spray nozzles, installed in the nozzle beams of the roller cooling and/or lubricating device, and of their corresponding control valves with respect to a simplification and acceleration of required repair and maintenance work.

In accordance with the present invention, this is achieved in that nozzle beams are provided which are rotatable about their longitudinal axis by means of a rotary drive and displaceable in the direction of the longitudinal axis by means of a linear drive.

The spray angle of the spray nozzles of the nozzle beams relative to the rollers, which is adjustable in the roller cooling and/or lubricating device according to the invention by rotating the nozzle beams about the longitudinal beam axis, provides a further parameter in addition to the adjustability of the nozzle beams relative to the respectively correlated roller transverse to the strip running direction as well as to the change of the quantity, the pressure, and the temperature of the rolling oil sprayed onto the rollers or the sprayed-on emulsions for changing the spray pattern on the roller surface within the context of a strip flatness control. The spray angle of the spray nozzles as an additional parameter makes possible an optimization of the strip flatness control. By rotating the nozzle beam by 180°, the spray nozzles can be moved in a simple way from the roller-proximal working position into a roller-remote maintenance position for a simple and fast performance of required maintenance and repair work.

The invention will be explained in the following with the aid of schematic drawings of a roller cooling and/or lubricating device employed in a four-high stand.

DESCRIPTION OF THE PREFERRED EMBODIMENTS

Figure 1:
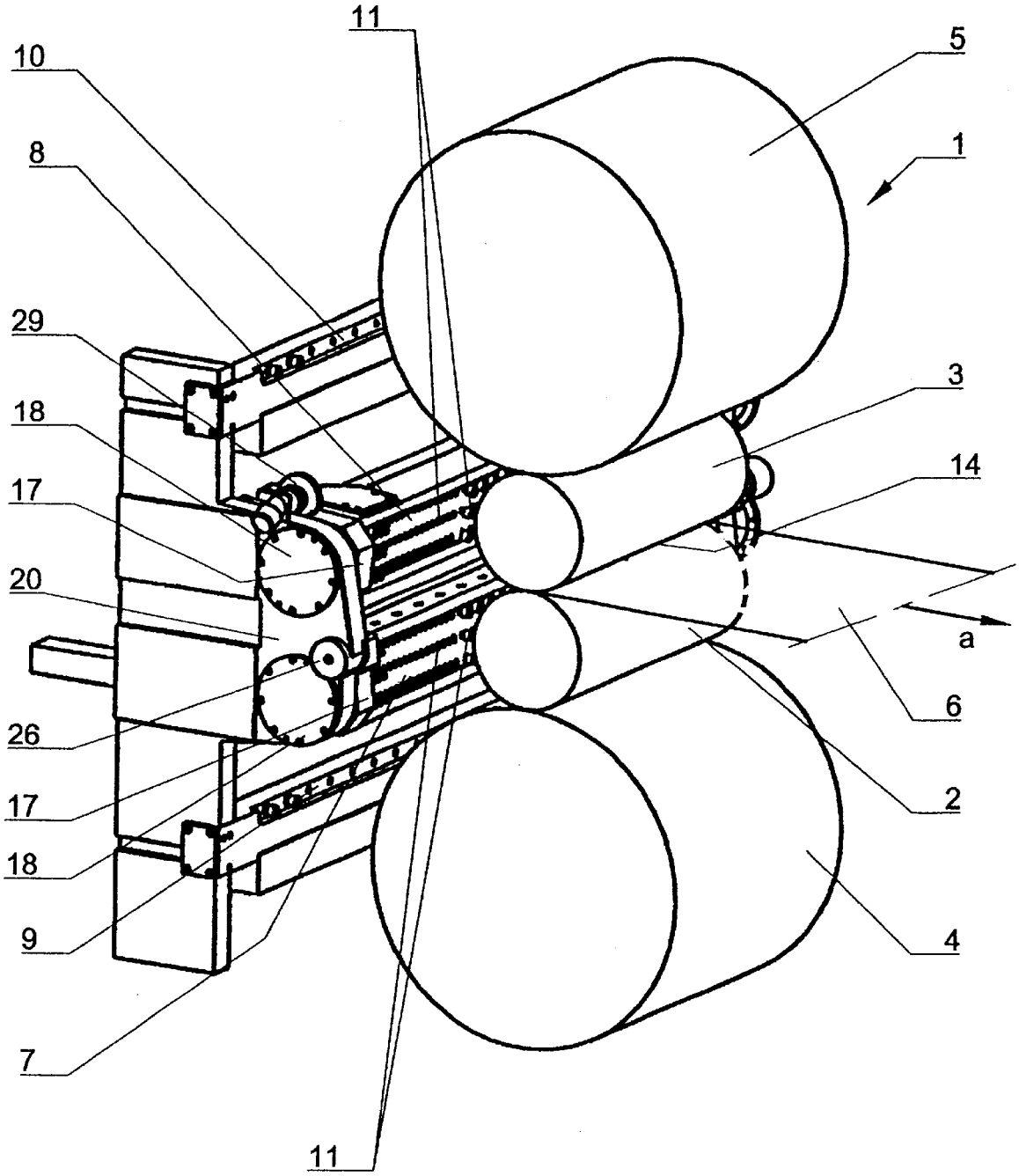
FIG. 1 is a perspective view of a four-high stand with nozzle beams for cooling and lubricating the working rollers and the support rollers.
Figure 2:
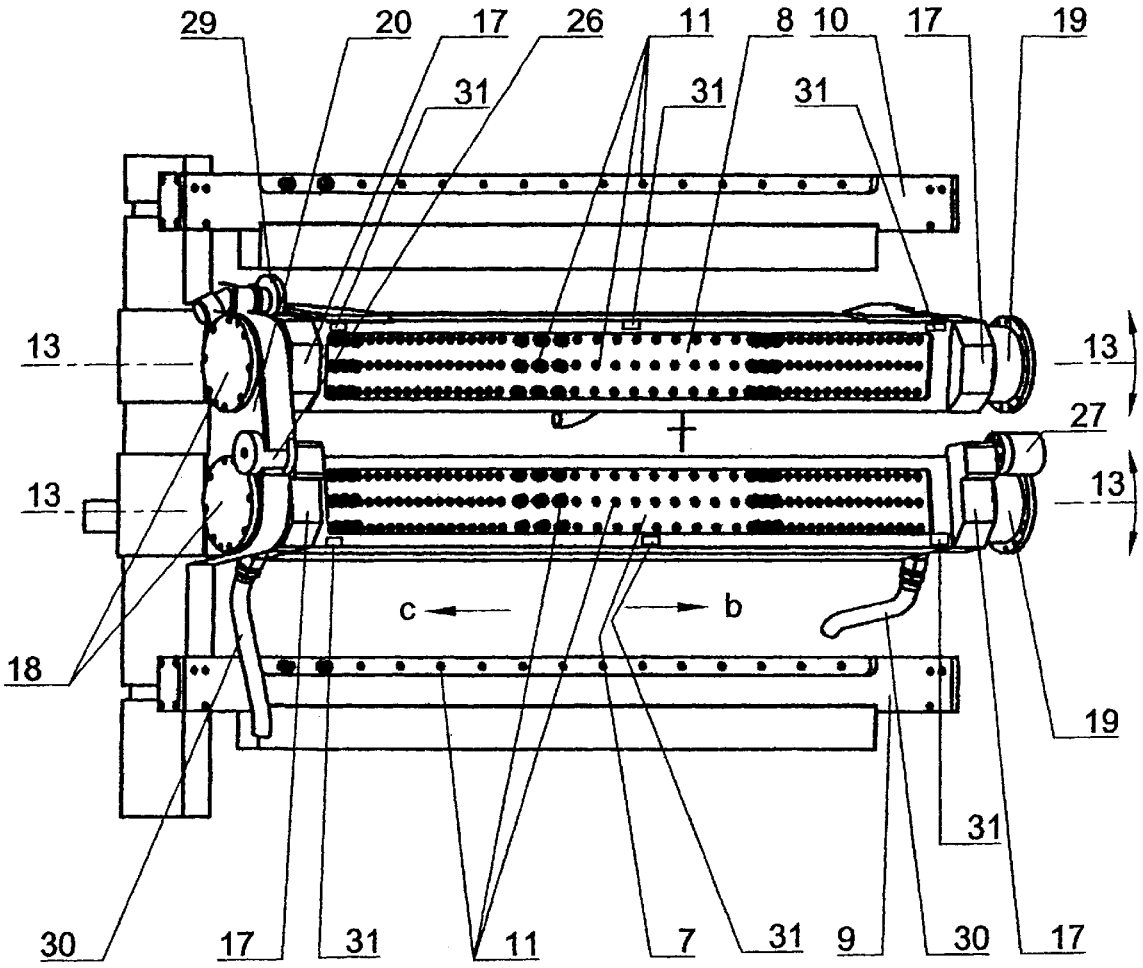
FIG. 2 is a front view of the nozzle beams according to FIG. 1.

The four-high stand of FIG. 1 is comprised of two roll housings, not shown, in which in chocks, not shown, an upper working roller 3 and a lower working roller 2 as well as a lower support roller 4 and an upper support roller 5 are rotatably supported.

The roller cooling and/or lubricating device, suitable for the flatness control of the rolled strip 6, for the working rollers 2, 3 and the support rollers 4, 5 is comprised of a nozzle beam 7, 8, respectively, assigned to the working rollers 2, 3 and a nozzle beam 9, 10 assigned to the support rollers 4, 5, respectively.

Across the width of the rollers, spray nozzles 11 are mounted in the nozzle beams 7–10 with control valves 12, arranged upstream thereof and formed as solenoid valves, for supplying cooling oil and/or emulsions onto the rollers 2–5. The nozzle beams 9, 10 correlated with the support rollers 4, 5 are stationary, while the nozzle beams 7, 8 correlated with the working rollers 2, 3 are slidable in the direction of arrows b, c in the direction of their longitudinal axis 13-13 transverse to the strip running direction a across the strip width and rotatable about their longitudinal axis 13-13.

The respective supply of rolling oil and/or emulsions to the adjustable nozzle beams 7, 8 and the stationary nozzle beams 9, 10 is controlled with pressure control and/or quantity control and/or temperature control.

By a movement of the nozzle beams 7, 8 in the direction of the longitudinal axis 13-13 of the beams transverse to the running direction a of the rolled strip 6 and by rotating the nozzle beams 7, 8 about the longitudinal axis 13-13 of the beam for adjusting the spray angle of the spray nozzles 11 relative to the working rollers 2, 3, the spray zone width of the spray nozzles 11 onto the working rollers 2, 3 and the spray pattern of the spray nozzles 11 are adjusted. The control of pressure, temperature, and quantity of the rolling oil, respectively, of the sprayed-on emulsions supplied to the nozzle beams 7, 8 affects the cooling of the working rollers 2, 3 and thus the size and the speed of the change of the effective roll barrel diameter and of the rolling gap 14, dependant thereon, between the working rollers 2, 3, respectively, affects the lubrication of the working rollers.

By means of a flatness measuring roll, not illustrated, at the exit of the strip behind the roller set, values of the strip tensile stress distribution across the strip width of the rolled strip 6 are measured, then processed in a computer, and used for controlling the cooling and/or the lubrication of the working rollers 2, 3 by means of the movable and rotatable nozzle beams 7, 8.

With a precise positioning of the nozzle beams 7, 8 with the spray nozzles 11, which beams are moveable in the direction of the longitudinal beam axis 13-13 transverse to the strip running direction a and rotatable about the longitudinal beam axis, undesirable strip tensile stress deviations can be compensated in zones within the rolled strip 6, and a planar strip can be produced thereby.

On the two ends 15, 16 of the two nozzle beams 7,8 correlated with the working rollers 2, 3, adaptors 17 are mounted on two hollow bearing journals 18, 19 for rotatable and movable support of the nozzle beams about and in the direction of the longitudinal beam axis 13-13. The bearing journals 18, 19 are provided in the side shields 20, 21 on the two roll housings (not illustrated) of the four-high stand 1 wherein the supply of cooling medium, respectively, of emulsions to the spray nozzles 11 mounted in the nozzle beams 7, 8 and to the corresponding control valves 12 is realized by a supply line 22 in a side shield 20, the hollow space 23 of the bearing journal 18 mounted in the side shield 20, the interior space 24 of the adaptor 17 seated on the bearing journal 18, and the distribution channel 25 of the nozzle beams 7, 8.

The supply of cooling medium to the nozzle beams 7, 8 can also be realized by a respective supply line 22 in both side shields 20, 21, the hollow bearing journals 18, 19 mounted therein, the adaptors 17 seated thereon, and the distribution channel 25 of the nozzle beams.

Hydraulic adjusting cylinders 26, 27 with adjusting pistons 28, acting on the adaptors 17, are arranged on the two bearing journals 18, 19 of the nozzle beams 7, 8 for moving the nozzle beams 7, 8 in the direction of arrows b, c transverse to the running direction a of the rolling strip 6.

A rotary drive 29 is mounted on the side shields 20, 21, respectively, and engages a respective adaptor 17 for rotating the nozzle beams 7, 8 about their longitudinal axis 13-13

The connecting cables for the control valves 12 of the spray nozzles 11 of the nozzle beams 7, 8 are combined in several flexible protective hoses 30, wherein the length of the connecting cables of the control valves is dimensioned such that a rotation of the nozzle beams 7, 8 about the longitudinal axis 13-13 of the beam is possible.

Figure 3:
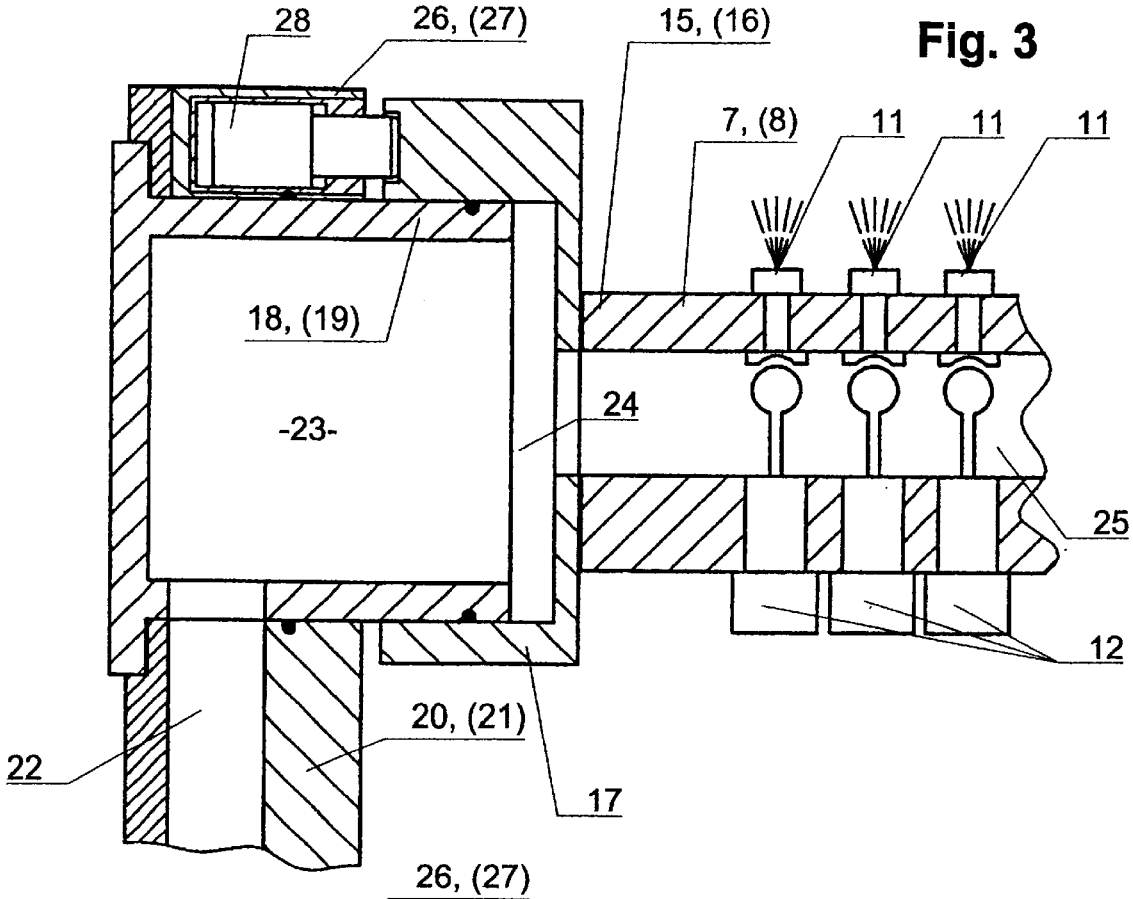
FIG. 3 is a section view of a rotational and sliding support of one end of a nozzle beam positioned in the working position.
Figure 4:
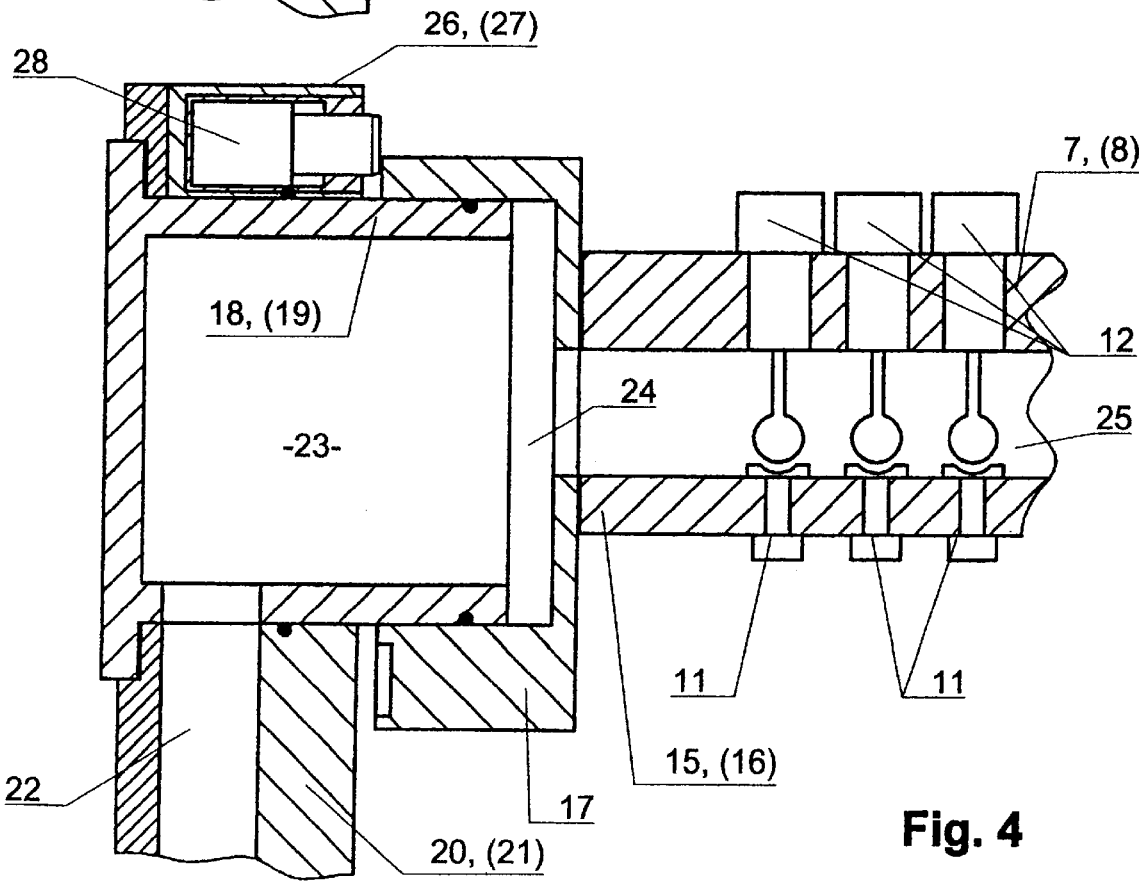
FIG. 4 is a section view of a rotational and sliding support of the nozzle beam in a maintenance position which is rotated relative to the illustration of FIG. 3 by 180°.

For repair and maintenance work on the spray nozzles 11 the nozzle beams 7, 8 can be rotated from their working position according to FIG. 3 by 180° into the maintenance position according to FIG. 4 in which the spray nozzles 11 facing away from the working rollers 2, 3 are freely accessible. Maintenance and repair work on the control valves 12 of the nozzle beams 7, 8 are expediently performed in the working position of the nozzle beams according to FIG. 3.

Temperature sensors 31 are integrated in the nozzle beams 7, 8 for the working rollers 2, 3 for the purpose of measuring the size of the thermal roll barrel external to the maximum strip width and at the roller center by means of a temperature measurement of the roller surface for compensating or equalizing the rolling gap model.

In deviation from the afore described embodiment of the novel roller cooling and lubricating device, there is the possibility of providing an additional movability and rotatability of the nozzle beams 9, 10 for the support rollers 4, 5 in the direction of the longitudinal axis, respectively, about the longitudinal axis of the beam. Moreover, a movability of the nozzle beams 7, 8 for the working rollers 2, 3 and of the nozzle beams 9, 10 for the support rollers 4, 5 together or independent from one another is conceivable, or only the movability of the nozzle beams 7, 8 for the working rollers 2, 3 from a maintenance position remote from the roller into the working position and from the working position into the maintenance position.

While specific embodiments of the invention have been shown and described in detail to illustrate the inventive principles, it will be understood that the invention may be embodied otherwise without departing from such principles.

What is claimed is:

1. A cooling and lubricating device for rollers of a cold rolling mill for strip having one or more roll stands for controlling tensile stress of the strip across the strip width by realizing at least one of a change of the effective roll barrel diameter and a change of the roller lubrication with a controlled supply of rolling oil or emulsions to the rollers, wherein the Controlled supply is at least one of pressure-controlled, quantity-controlled, and temperature-controlled; the device comprising:

several nozzle beams having a longitudinal axis and being assigned to individual rollers, respectively;

the nozzle beams configured to be connected to side shields of a roll housing of the one or more roll stands;

spray nozzles mounted in the nozzle beams so as to be distributed across an entire width of the rollers;

the nozzle beams moveable relative to the correlated rollers and independently of one another transverse to a running direction of the strip running through the cold rolling mill and in planes positioned parallel to a plane of the strip;

one or more rotary drives connected to the nozzle beams and configured to rotate the nozzle beams about the longitudinal axis; and one or more linear drives connected to the nozzle beams and configured to move the nozzle beams in a direction of the longitudinal axis, wherein:

each one of the nozzle beams has opposed ends in the direction of the longitudinal axis;

each one of the nozzle beams has adapters connected to the opposed ends and a hollow bearing journal seated in the adapters and mounted in the side shields, respectively;

the adapters are configured to rotatably support the nozzle beams about the longitudinal axis and to slidably support the nozzle beams in the direction of the longitudinal axis on the two hollow bearing journals;

the spray nozzles have control valves;

the hollow bearing journals have hollow spaces;

the device further comprises a supply system configured to realize the controlled supply of the rolling oil and the emulsions to the spray nozzles and the control valves;

the supply system comprises a supply line arranged in at least one of the side shields and connected to the hollow space of the hollow bearing journal mounted in the at least one side shield and an interior space of the adapter seated on the hollow bearing journal;

the supply system further comprises a distribution channel in each one of the nozzle beams, wherein the distribution channels communicate with the interior space of the adapters;

the linear drive comprises adjusting cylinders seated on the hollow bearing journals of the nozzle beams and configured to act on the adapters for sliding the nozzle beams in the direction transverse to the running direction;

the rotary drive is configured to act on one of the adapters of the nozzle beams for rotating the nozzle beams about the longitudinal axis.

2. The device according to claim 1, wherein the nozzle beams for the rollers that are working rollers are configured to be moveable back and forth in the running direction from a maintenance position remote from the working rollers into a working position near the working rollers and from the working position near the working rollers to the maintenance position.

3. The device according to claim 1, wherein the nozzle beams assigned to the rollers that are working rollers and the nozzle beams assigned to the rollers that are support rollers are configured to be moved together in the running direction from a maintenance position remote from the working rollers into a working position near the working rollers and from the working position near the working rollers to the maintenance position.

4. The device according to claim 1, wherein the nozzle beams assigned to the rollers that are working rollers and the nozzle beams assigned to the rollers that are support rollers are configured to be moved separately in the running direction from a maintenance position remote from the working rollers into a working position near the working rollers and from the working position near the working rollers to the maintenance position.

5. The device according to claim 1, wherein the nozzle beams assigned to the rollers that are working rollers have integrated temperature sensors configured to measure a size of the thermal roll barrel outside of the maximum strip width and at the center of the roller by measuring a surface temperature of the roller surface for compensating a rolling gap model, wherein the nozzle beams with the temperature sensors are arranged on an inlet side of the strip into the roll stand.

6. A cooling and lubricating device for rollers of a cold rolling mill for strip having one or more roll stands for controlling tensile stress of the strip across the strip width by realizing at least one of a change of the effective roll barrel diameter and a change of the roller lubrication with a controlled supply of rolling oil or emulsions to the rollers, wherein the controlled supply is at least one of pressure-controlled, quantity-controlled, and temperature-controlled; the device comprising:

several nozzle beams having a longitudinal axis and being assigned to individual rollers, respectively;

the nozzle beams configured to be connected to side shields of a roll housing of the one or more roll stands;

spray nozzles mounted in the nozzle beams so as to be distributed across an entire width of the rollers;

the nozzle beams moveable relative to the correlated rollers and independently of one another transverse to a running direction of the strip running through the cold rolling mill and in planes positioned parallel to a plane of the strip;

one or more rotary drives connected to the nozzle beams and configured to rotate the nozzle beams about the longitudinal axis; and one or more linear drives connected to the nozzle beams and configured to move the nozzle beams in a direction of the longitudinal axis, wherein:

each one of the nozzle beams has opposed ends in the direction of the longitudinal axis;

each one of the nozzle beams has adapters connected to the opposed ends and a hollow bearing journal seated in the adapters and mounted in the side shields, respectively;

the adapters are configured to rotatably support the nozzle beams about the longitudinal axis and to slidably support the nozzle beams in the direction of the longitudinal axis on the two hollow bearing journals;

the spray nozzles have control valves;

the hollow bearing journals have hollow spaces;

the device further comprises a supply system configured to realize the controlled supply of the rolling oil and the emulsions to the spray nozzles and the control valves;

the supply system comprises a supply line arranged in at least one of the side shields and connected to the hollow space of the hollow bearing journal mounted in the at least one side shield and an interior space of the adapter seated on the hollow bearing journal;

the supply system further comprises a distribution channel in each one of the nozzle beams, wherein the distribution channels communicate with the interior space of the adapters;

the linear drive comprises adjusting cylinders seated on the hollow bearing journals of the nozzle beams and configured to act on the adapters for sliding the nozzle beams in the direction transverse to the running direction;

the rotary drive is configured to act on one of the adapters of the nozzle beams for rotating the nozzle beams about the longitudinal axis, wherein the control valves are solenoid valves having two electrical connecting lines, wherein the electrical connecting lines of several of the solenoid valves are combined and enclosed by flexible protective hoses.

* * * * *